US005654037A

United States Patent [19]

Moore et al.

[11] Patent Number: 5,654,037

[45] Date of Patent: Aug. 5, 1997

[54] METHOD OF MINIMIZING DEFECTS IN PAINTED COMPOSITE MATERIAL PRODUCTS

[75] Inventors: John H. Moore, Waterford; Mark J. Marentic, Sylvan Lake, both of Mich.

[73] Assignee: APX International, Madison Heights, Mich.

[21] Appl. No.: 409,975

[22] Filed: Mar. 24, 1995

[51] Int. Cl.[6] ..... B05D 3/02; B05D 1/38; B05D 7/02

[52] U.S. Cl. ..... 427/379; 427/316; 427/322; 427/412.1

[58] Field of Search ..... 427/316, 379, 427/409, 412.1, 322

[56] References Cited

U.S. PATENT DOCUMENTS

| | | | |
|---|---|---|---|
| 0,665,747 | 1/1901 | Martin | 427/282 |
| 2,763,575 | 9/1956 | Bede | 117/104 |
| 2,861,897 | 1/1958 | Hendrixson | 117/47 |
| 3,042,547 | 7/1962 | Pickett | 117/102 |
| 3,073,721 | 1/1963 | Pokorny | 117/105.1 |
| 3,839,080 | 10/1974 | Jarema et al. | 117/132 B |
| 3,911,178 | 10/1975 | McDowell et al. | 427/316 |
| 4,024,304 | 5/1977 | Smock et al. | 427/316 |
| 4,138,513 | 2/1979 | Srock et al. | 427/371 |
| 4,265,936 | 5/1981 | Prohaska, Jr. | 427/140 |
| 4,327,131 | 4/1982 | Branovich et al. | 427/229 |
| 4,368,222 | 1/1983 | Blegen et al. | 427/340 |
| 4,395,441 | 7/1983 | Farnam | 427/211 |
| 4,456,804 | 6/1984 | Lasky et al. | 219/10.43 |
| 4,659,412 | 4/1987 | Newman et al. | 156/322 |
| 4,690,837 | 9/1987 | Doroszkowski et al. | 427/314 |
| 4,731,262 | 3/1988 | Ohno et al. | 427/379 |
| 4,908,231 | 3/1990 | Nelson et al. | 427/55 |
| 4,919,977 | 4/1990 | Yamane et al. | 427/379 |
| 4,933,214 | 6/1990 | Sugiura et al. | 427/379 |
| 4,943,477 | 7/1990 | Nelson et al. | 427/55 |
| 4,968,530 | 11/1990 | Yamane et al. | 427/142 |
| 5,021,297 | 6/1991 | Rhue et al. | 427/316 |
| 5,091,215 | 2/1992 | Tanimoto et al. | 427/240 |
| 5,120,415 | 6/1992 | Yuan | 427/379 |
| 5,130,173 | 7/1992 | Barten et al. | 427/314 |
| 5,131,702 | 7/1992 | Mattysse et al. | 293/121 |
| 5,415,894 | 5/1995 | McGarry | 427/386 |

FOREIGN PATENT DOCUMENTS

| | | | |
|---|---|---|---|
| 3916948 | 12/1989 | Germany | 427/316 |

OTHER PUBLICATIONS

*Hard Rubber Finishes*, Bennett, *Rubber Age*, vol. 69, Jul. 1951, pp. 437–440.

Editorial by Michael C. Gabrielle, Associate Editor, "RTM Composites, What the Viper Project Taught Us", Plastics Technology (Mar., 1994).

*Primary Examiner*—Diana Dudash

*Attorney, Agent, or Firm*—Harness, Dickey & Pierce, P.L.C.

[57] ABSTRACT

A process for painting a fiber reinforced composite plastic member. Prolonged pre-heating of the composite member is used to minimize defects in a subsequently applied clear resin finish coating. The finish coating is applied and curing of it commenced before the composite member has substantially cooled, effective to inhibit formation of pits and blisters in the clear finish coating, and delamination in pore areas beneath said clear finish coating.

10 Claims, 2 Drawing Sheets

METHOD OF MINIMIZING DEFECTS IN PAINTED COMPOSITE MATERIAL PRODUCTS

RELATED PATENT APPLICATION

This application is related to my U.S. patent application Ser. No. 08/409,972, filed Mar. 24, 1995, pending, attorney docket No. 7946-00004, entitled "Methods of Making Preforms for Resin Transfer Molding", and assigned to the assignee of this application. The disclosure of the above related patent application is incorporated herein by reference.

BACKGROUND OF THE INVENTION

1. Field of the Invention

This invention relates to minimizing defects in a painted coating on a composite material article. This invention more particularly relates to improvements that can be especially used in applying a clear finish coat over a color coating on a glass fiber/resin composite material article.

2. Description of the Prior Art

Before describing the prior art, it should be mentioned that fiber glass/thermosetting resin composites present special problems in painting, as compared to metal. Painting techniques that are satisfactory on metal, can produce blistering and cratering when used on glass fiber/resin composites. More specifically, the currently used clear coat final finishes used on automotive metal parts are cured at temperatures of about 250°–325° F. Use of such relatively high curing temperatures on composite parts can expand subsurface air bubbles in a composite part, to blister or crater the parts's surface. In view of such problems, use of paint systems that cure at lower temperatures have been tried. However, use of the lower cure temperatures produces still other problems. This invention provides means for solving one of those other problems that is particularly aggravating. The term "paint system" is intended to include all coatings used to form a "painted" surface on a part, including both a pigmented primer coat and a clear finish coat as well as the color coat. Accordingly, a clear finish coat that lies on a color coat of paint is still considered to be a "paint" for purposes of this invention, even thought the clear finish coat contains no pigment.

More specifically, this invention is particularly beneficial in minimizing defects in a clear resin finish coat of painted composite material automotive products, especially such products made of glass fiber-reinforced thermosetting resin. The defects are minimized by prolonged preheating of the composite material at a particular temperature, and then painting and curing the finish coat while the composite material remains substantially at that temperature. While the prior art contains references to preheating all types of products prior to painting, the prior art offers no suggestion of my process, or its benefits when painting composite materials.

As indicated above, the preheating of articles prior to painting is not new. A number of patents teach a variety of processes that involve heating of an article prior to and/or during painting, primarily to accelerate the drying process. For example, U.S. Pat. No. 0,665,747 Martin preheats both the article and the paint, and applies the paint in a heated chamber. U.S. Pat. No. 2,763,575 Bede heats the paint to self-pressurize the paint, then sprays the hot paint in a heated chamber. U.S. Pat. No. 5,130,173 Barten et al. discloses painting automotive radiators and condensers faster by preheating them and spraying them with preheated paint.

U.S. Pat. No. 2,861,897 Hendrixson describes a technique for applying an extra thick coating of paint to a metal article. The article is heated to a temperature just below the boiling point of the solvent in the paint. The article is passed through a solvent reflux (i.e., hot) zone of a columnar paint chamber, and sprayed with hot paint. The paint is then allowed to dry in the spray chamber, using latent heat in the metal article. The article exits the spray chamber by passing through the reflux zone quickly, to avoid rinsing off the paint layer. U.S. Pat. No. 3,042,547 Picket discloses that chlorinated paint solvents have coalescence and flow problems. Picket solves them using an apparatus and process analogous to that of Hendrixson. The part is apparently preheated in a solvent re-flux zone, and painted with jets of paint. The article is then dried at room temperature using its latent heat before it exits the apparatus. U.S. Pat. No. 3,073,721 Pokorny also recognized that chlorinated solvents do not coalesce and level off a paint film in an acceptable manner. Like Picket, Pokorny proposes preheating the workpiece in a re-flux zone of the paint solvent. The workpiece is preheated to a temperature just below the vaporization temperature of the paint solvent. The paint is heated to a temperature above its solvent vaporization temperature, and is then applied as a jet onto take preheated workpiece. Because the workpiece is cooler than the vaporization temperature of the paint solvent, the paint coalesces and levels off. However, the paint dries rapidly, whereupon the workpiece can be removed through the re-flux zone without rinsing off the paint.

The latter type of high temperature painting process may be satisfactory for metal. Metal workpieces can ordinarily safely withstand higher painting and drying, or curing, temperatures. It is not unusual to dry and/or cure metal automotive body parts at temperatures of about 250°–325° F., to accelerate the painting process. I have noted that the metal part absorbs heat rapidly, and releases it to the paint coating. I have recognized that this action substantially evaporates solvents substantially throughout the thickness of a paint coating before the surface of the paint coating hardens, i.e., dries.

On the other hand, none of the foregoing patents addresses methods for improving the quality of the specular, i.e., gloss, finish of paint on plastics, especially automotive SMC or RTM composites. It is noted that U.S. Pat. No. 3,911,178 McDowell et al. concerns painting injection molded thermoplastic automobile parts. McDowell et al. state that such parts inherently have a waxy surface residue that causes "fisheying". McDowell et al. solve the problem of "fisheying" by preheating the thermoplastic part to about 130° F., applying a barrier clear coat, partially curing the barrier clear coat, preheating the part to about 130° F. and applying a color coat. Thereafter, the color coat is fully cured at about 180°–260° F.

Different problems, from "fisheying", exist when painting a plastic part made of thermosetting resin. Among such thermosetting resin parts are glass fiber reinforced parts such as sheet molded (SMC) composite material parts and resin transfer molded (RTM) composite material parts. The current paint finishes for automotive body parts, whether of metal or composites, involve a lamination of coatings. The lamination includes a primer coating, a color coating, and a clear resin finish coat. The coatings are usually sprayed on as a liquid, utilizing a vaporizable solvent, and then dried. Drying involves solidification of the coating by vaporization of the solvent used to liquify it. However, the clear resin finish coat, is more than just dried. The clear resin finish coat is cured in a lengthy heating, that provides a durable lustrous finish having an apparent thickness or "depth" to the underlying color coat. Such laminar finishes can be readily applied to metal. However, when such paint systems are applied to an SMC and an RTM composite material product, special problems develop. The primer and color layers of such laminar paint systems are apparently formed fairly satisfactorily on a SMC or RTM composite product, with an exception hereinafter described. Unfortunately, the clear finish coat does not form nearly as well. The spraying of the clear finish coat onto the primer and color coats is not the problem. The problem involves curing of the clear coat finish. As indicated above, if the clear finish coat on composite substrates is cured at temperatures "normal" for curing it on a metal substrate, unique problems arise. Subsurface air bubbles in the composite, especially an RTM composite, can permanently expand, and even "pop", the composite's surface. This results in the substrate surface finish having smooth or cracked bumps, and even uncoated craters. One technique for reducing this problem is to preheat the composite part at cure temperatures, to reveal potential problem spots. After cooling the composite part, the revealed problem spots are repaired. Then, the clear finish coat is applied, hoping that no further such spots will reveal themselves when the clear finish coat is cured. An additional and/or alternative approach to solving this problem resides in simply curing the clear finish coat at a lower temperature (than used on metal). For example, the clear finish coat on SMC and RTM composite material products is now often cured at temperatures of approximately 160°–180° F.

Surprisingly, even at such low curing temperatures, the cured clear finish coat can still exhibit a blistered and/or cratered appearance. However, I have found that this latter blistering and/or cratering is in the clear finish coat, itself. It is not in the substrate. Hence, preheating to curing temperatures does not even reveal potential trouble spots for repair. I have found that this latter type of blistering and/or cratering is due to a different mechanism than the blistering and/or cratering referred to in the preceding paragraph. I have found that blistering and/or cratering in the clear coat finish is related to porosity, not air bubbles, in the SMC or RTM substrate. Porosity in the surface of an SMC and RTM composite material part exists even after the part has received a primer and color coating of paint. Moreover, the clear coat blistering and/or cratering problem is aggravated in RTM articles having an thick foam inner layer. The clear coat cratering and blistering problem may even be still more aggravated in RTM articles in which the thick foam inner layer has a metal reinforcement.

I have discovered that the cratering and blistering in and under the clear coat is associated with registered porosity in the composite article and in its primer and color coatings. Further, I have discovered that a simple modification of the clear coat painting technique can overcome the adverse effects of this registered porosity.

OBJECTS AND SUMMARY OF THE INVENTION

It is object of this invention to provide an improved process for applying a cured clear coating on a fiber reinforced thermoset plastic composite material article.

Another object of this invention is to provide an improved process for forming a cured clear coating onto a color coated surface on a foam-backed resin transfer molded composite material automotive body part.

Still another object of the invention is to provide a process for reducing defects in a laminar paint coating on a thermoset resin composite material automotive body part reinforced with glass fiber, especially an SMC or RTM part.

These and other objects features and advantages of this invention are obtained in a laminated paint coating applied to an article made of a fiber-reinforced thermosetting resin. The laminated paint coating includes a primer coating, a color coating, and a clear resin coating. The clear resin coating is heated for an extended period after it is applied, to cure it. In a one example of this invention the primer and color coats can be applied in any normal and accepted manner. Thereafter, the composite material article is preheated to a predetermined temperature for a sufficient time to heat the article substantially throughout its thickness to the predetermined temperature. For thicker automotive composite parts, the preheating time may have to be about an hour. Then, while the article is still substantially at the predetermined temperature, the clear resin coat is sprayed onto the article. Soon after that, while the article is still substantially at the predetermined temperature, additional heat is applied to the coated article to cure the resin coating.

Typical automotive paint systems for RTM and SMC composite products have clear coatings that are cured at temperatures of about 160°–180° F. The predominant solvents in such resins will apparently vaporize at about 250°–265° F. The currently preferred preheating temperature for composites in accordance with this invention about 155° F.

Other objects features and advantages of this invention will become more apparent from the drawing and from the following detailed description of the invention.

DETAILED DESCRIPTION OF THE PREFERRED EMBODIMENTS

This invention involves a process for minimizing defects in an automotive-type laminated paint coating on a fiber-reinforced thermosetting resin article. Typically, the reinforcing fiber would be a glass fiber. I refer herein to such an article as a composite material or fiber-reinforced plastic article. The composite plastic articles contemplated in this invention include sheet molded composite (SMC) articles, and especially resin transfer molded (RTM) articles.

Figure 1:
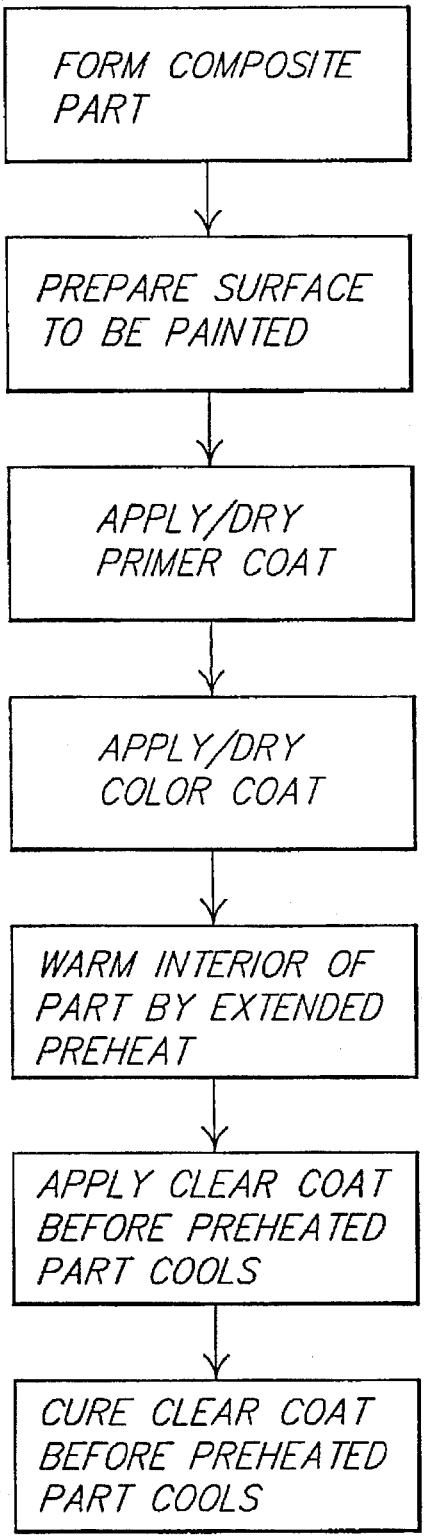
FIG. 1 is a diagrammatic view showing of the successive steps of the method of this invention.
Figure 2:
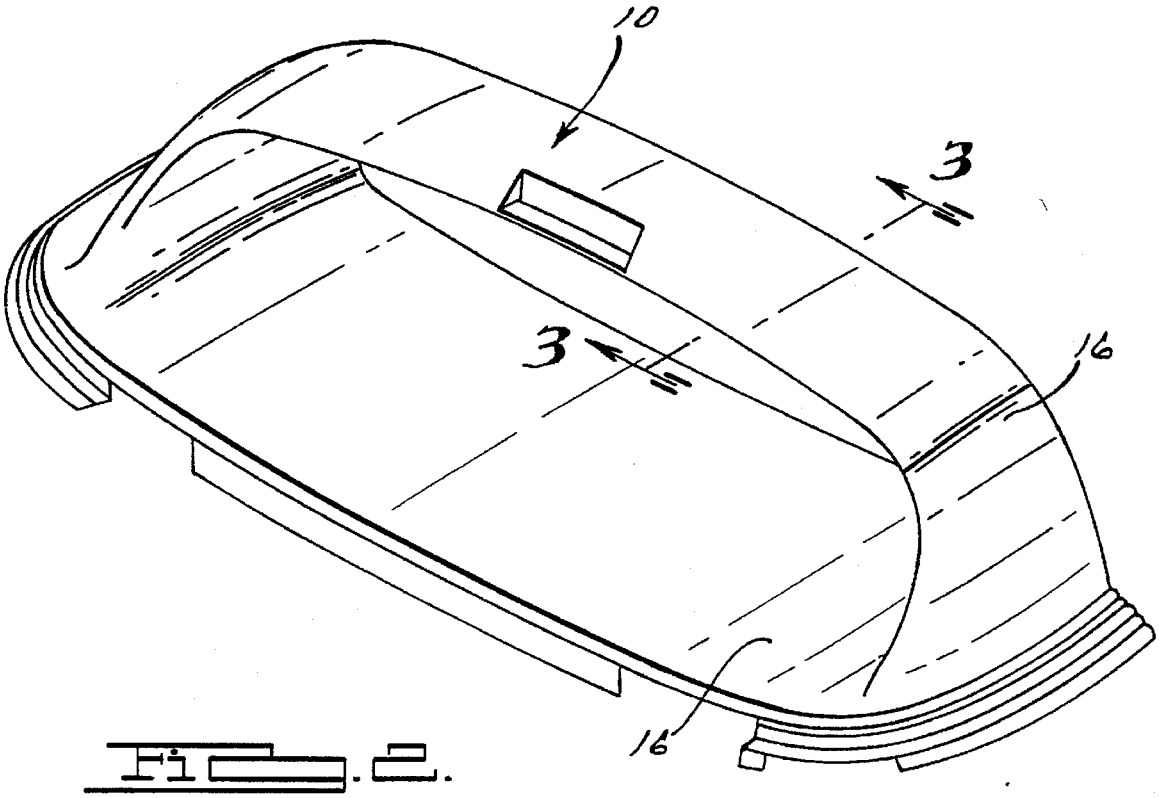
FIG. 2 is a perspective view showing the sport cap of the 1994 model year Chrysler Viper® sport coupe automobile.
Figure 3:
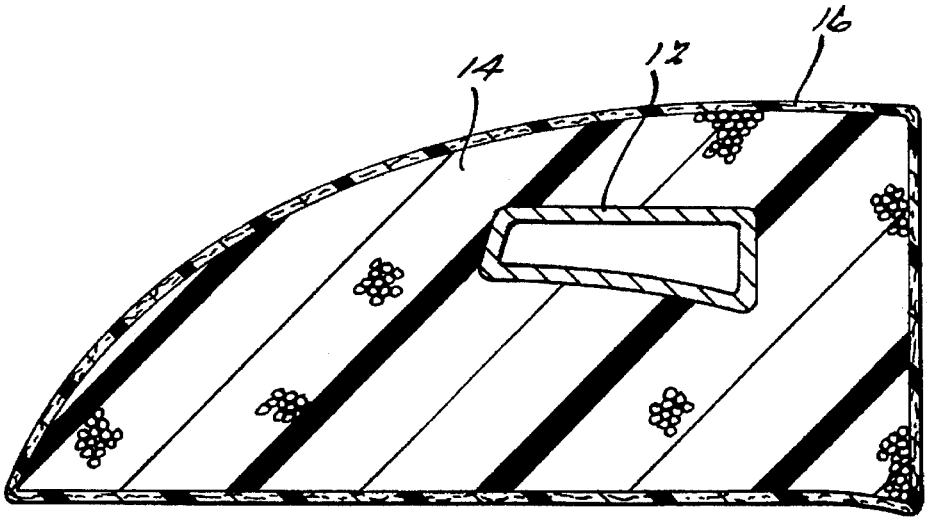
FIG. 3 is a cross-sectional view along the line 3—3 in FIG. 2.

One such RTM article is a sport cap 10 body part for the 1994 Chrysler Viper® sport coupe automobile, which is illustrated in FIGS. 2 and 3 of the drawing. The sport cap 10 is a large composite material part having a tubular metal central reinforcement 12 that has a shape analogous to a roll bar. The metal reinforcement 12 is embedded in a highly stylized thermosetting resin closed cell foam body 14. The foam of body 14 could be a urethane type of thermosetting resin that is foamed in place around the tubular reinforcement 12. The thermosetting resin foam body 14 is, in turn, covered by a thermosetting resin high density outer shell 16. Outer shell 16 is RTM molded in place, and includes reinforcement by glass fiber sheets or mats. The outer shell could be of a poly ester, epoxy or urethane thermosetting resin. Formation of such a product is described more fully in my above identified related patent application entitled "METHODS OF MAKING PREFORMS FOR RESIN TRANSFER MOLDING" (attorney docket Number 7946-00004), which is incorporated herein by reference.

I believe this invention is specially applicable to both SMC and RTM articles because both have a glass fiber reinforcement in a thermosetting matrix. SMC and RTM products halve porous surfaces, some of which porosity is associated with glass fibers that intersect the article surface. I have recognized that a capillary passage can exist at the resin/fiber interface for each glass fiber, and extend along the length of the glass fiber. This produces a porosity in a seemingly non-porous article, which communicates the surface of the article with its interior.

Also, I have recognized that such composite material porosity is not sealed by the primer and color coats of currently available laminar automotive paint systems. In fact, the primer and color coatings of such laminar systems are also porous. I have recognized that some of the pores in the primer and color coatings are not only registered with each other but also with pores and capillaries in the composite article surface. Hence, I have further recognized that there can be a direct communication between the exterior surface of the color coating and the interior of the article, through pores and capillary passages. More will be said about this later, in connection with a description as to how the clear coat blistering and cratering problem can also exist in the primer and color coats as well.

I have recognized that SMC and RTM composite articles have a low thermal conductivity, and usually have a much greater thickness than metal counterparts of the same part. Parts made of RTM composite materials are often designed to have quite significant thicknesses. I have recognized that the low thermal conductivity and large thickness (compared to metal), and the aforementioned porosity, causes defects to occur in the clear resin finish coat of the above-mentioned laminar automotive-type paint systems. Such defects have occurred even thought the painting system used provides no such defects when applied to metal articles.

The various layers of the above-mentioned laminar paint system are conventionally applied substantially at room temperature to large composite automobile body parts. Solvents in the coatings are removed by subsequent application of heat. I have found that on SMC and RTM types of articles, solvents in the resin clear finish coat do not all readily evaporate in conventional curing heat treatments. By solvents, I mean to include all the vaporizable substances that are in paint, as well as the predominant solvent or vehicle. The predominant solvent is probably among the most volatile of the vaporizable substances in the paint. By most volatile, I mean it will have the longest boiling point.

I have found that quantities of solvent in the clear finish coating migrate into the above-mentioned pores and capillaries of the composite article before the exterior of the clear finish coating dries. In other words, I have noted that the clear finish coat can "skin over" before the migrated quantities of solvent have evaporated. By "skin over", I mean that the outer major surface of the clear resin layer starts to harden. When this occurs, an evaporating solvent quantity finds it increasingly difficult to escape to the ambient. In such a progressive effect, solvent bubbles can burst on the coating surface without subsequently leveling out. Solvent bubbles can become entrapped in the coating. The migrated quantities of solvent can even become entrapped below the clear finish coat, to cause delamination adjacent the pores. The bubbles and delamination can impair specularity of the resulting painted surface, and can even show up as relatively large blisters. The clear finish coat in an automotive-type laminar paint system is a resin that must be cured at an elevated temperature for an extended period. I have found that during this extended heating, for SMC and RTM articles, the inner face of the clear finish coat does not immediately rise to solvent vaporization temperatures. In retrospect, I believe that in prior painting methods, the inner face of the clear finish coat was cooled by the large, cool mass of the composite part. Eventually it warms and hardens, but not before some of the solvent in the finish coat migrates into underlying porosity. One may choose to refer to this as absorption. When the clear finish coat hardens, the migrated, or absorbed, solvent portions become entrapped below its surface. Their vaporization after the clear coating has hardened, can result in raising and even popping off of the hard resin coat over a pore. Such action forms a blister or crater in the finished surface. Analogous to the above, evaporation of the entrapped clear finish coat solvent, can also cause the solvent vapor to expand deeper into the composite part, along the sides of the glass fibers. If the composite part has a foam inner core, such as foam body 14 of the part shown in FIGS. 2–3, the vapor can even reach the interface between the foam body and the reinforced plastic outer shell 16. Such internal expansion can cause lateral expansion at that foam/shell interface, to cause it to separate surrounding the pore area. The late-evaporating solvent call also expand laterally from a pore into the interfaces at the upper and lower surfaces of the primer coating to delaminate and bubble them. Such actions can be evidenced as a small or large blister on the surface of the painted article. Vaporization of the migrated solvent, after the outer surface of the clear finish coat has hardened but before its inner surface has hardened, can form a bubble in the clear finish coat.

In this invention, the above-mentioned defects can be avoided by heating the composite material article after the primer and color coatings have been applied. The heating is to a predetermined temperature that is preferably less than, but close to, the temperature used to cure the clear coat resin. This is probably not a temperature above the boiling point temperature of the solvent in the clear finish coat. One would not want the clear finish coat to boil when it is applied. On the other hand, it is a temperature that significantly accelerates evaporation of the predominant solvent in the clear coat resin. Heating to a temperature close to the normal cure temperature can accelerate evaporation of the solvent, which concurrently suppresses its absorption. Heating to just below the cure temperature does not appear to interfere with the predetermined flow characteristics of the clear coat when it is applied. Heating to at or above the cure temperature may tend to produce such interference. Hence, the heating is preferably (a) to a temperature just below the cure temperature of the clear finish coat, and (b) for a sufficiently long time to heat the article throughout its thickness to that temperature.

It is important that the composite article be sprayed with the clear finish coat while the composite article is still substantially at that preheating temperature. Thereafter, still without allowing the article to substantially cool, the clear finish coat is heated to cure it. In such instance, absorption of solvents in the clear coat will be suppressed and substantially evaporated before any significant "skin over" occurs on the clear coat.

In other words, in this invention the interior major surface of the clear finish coat is maintained just below the cure temperature from the moment it is applied. Thus, one inhibits any substantial downward migration of solvent from the finish coat during both application and curing of the clear finish coating. Solvents tend to evaporate early, or at least remain in the clear finish coat prior to application of cure temperatures. Those solvent portions that still remain in the clear finish coat can thus more readily evaporate before "skin over" of the clear finish coating occurs.

In a specific example of this invention, the article can be an RTM composite article, such as the above described sport cap 10 on a 1994 Viper®. As also indicated above, the Viper® sport cap is a highly stylized roof component. In making such a product, a closed cell moderate density thermosetting resin foam body 14 is molded around a metal reinforcing structure 12, to impart an approximate aerodynamic shape. Preformed fiberglass mats are disposed on opposed faces of the foam body 14, and a high density thermosetting resin molded onto those faces. This provides a high density and reinforced surface shell 16 on the sport cap. The as-molded sport cap is then trimmed and its surface 18 prepared for application of a primer coat of paint.

The surface preparation can be as simple as merely wiping the surface with an organic solvent, to remove organic contaminants. Abrasion is frequently used as the surface preparation, to increase adhesion of the primer coating of paint. The surface of such composite material parts normally will have a number fine pores. Abrading the surface exposes still more pores. In addition, abrasion can expose and brake off ends of glass fibers leaving a pore exposed on the surface that communicates with a capillary passage alongside the surface of the glass fiber. Even without the abrasion, a number of naturally occurring pores can communicate with the capillary passages.

A primer coating of paint is then sprayed onto to the thus-prepared surface, and allowed to dry. Following application of the primer coating, a color coating is sprayed onto the primer coating and allowed to dry. Each of the primer and color coatings is applied in the normal and accepted manner, which means that each coating may be formed by multiple passes of a spray gun. As indicated above, I have noted that each of the primer and color coatings have a plurality of fine pores therein, at least some of which register with each other and with the pores that occur in the surface of the composite material part.

The thus-coated composite material part is then heated for a sufficient duration to raise its interior temperatures to a significant predetermined level. I prefer that level to be one that accelerates evaporation of the solvents such as in the in the clear finish coat, at least the principal solvent. As mentioned, heating to a temperature close to that of the curing temperature of the clear finish coat is preferred. It should be appreciated that the heating time required for such an effect is normally rather long for composite material articles, as compared to metal. This is because of the composite articles usually have a higher thickness and lower thermal conductivity than metal. For example, I prefer to heat the Viper® port cap for about an hour at 155° F., to insure minimization of the above-described defects in its clear finish coating. The clear finish coat for the subject part is cured for about one hour at about 160°–180° F. The clear finish coat is applied before the sport cap has significantly cooled, preferably immediately but at least within about 5 minutes. The clear finish coat is applied unheated, and is sprayed in a substantially room temperature chamber. Cure of the clear finish coat is preferably commenced substantially immediately after its application, and hopefully within 1–2 minutes after application. Certainly, it should be started within less than 5 minutes after application.

Cure temperatures for such a clear finish coat are typically about 160°–180° F., as they would preferably be on any other SMC and RTM automotive composite material part. It is recognized that higher cure temperatures might be used. However, for the reasons outlined above, curing the clear finish coat at higher temperatures is usually not desirable. The clear coat cure temperatures of about 275°–350° F. typically used on metal substrates, are usually to be avoided when painting composite substrates for reasons hereinbefore noted.

In the above example, the composite part is preheated to a temperature no more than about 25° F. from the cure temperature, and preferably within about 10°–15° F. of the cure temperature. In the most preferred form, it is within about 10° or 15° F. less than the cure temperature. The reason for preferably preheating to a temperature slightly less than the cure temperature, is as outlined above. Preheating to a higher temperature may cause the solvents of the clear finish coat to flash off too quickly. If so, the sprayed droplets of the clear coat resin may not coalesce and level off enough for providing the desired specular appearance. In such instance, blistering and cratering will be prevented, but the desirable specular appearance of the finish coating will not be achieved. However, if a high degree of specularity, or gloss, is not needed, this may not be a problem.

Accordingly, for high gloss automotive finishes, with a clear coat that cures at a temperature of about 160°–180° F., I prefer preheating to a temperature of approximately 145°–165° F., and most preferably 150°–160° F. It should also be recognized that heating of the composite article at a higher temperature for a shorter period of time can perhaps produce a resultant average temperature such as described above. On the other hand, this is ordinarily to be avoided because it can produce too high an actual temperature on the surface of the part that is to be coated. I do not prefer that technique but recognize that it might possibly be used.

It is emphasized that in order for the objects of this invention to be obtained, not only should the part be preheated but that the clear coat finish has to be applied, and curing commenced, before the preheated part has substantially dropped in temperature. If spraying and/or curing is delayed, the substrate may cool too much and allow migration of the clear finish coat solvents into the pores of the composite material substrate. Then the benefits of the preheating are not realized. Any convenient technique for preheating the composite metal article can be used, including using latent heat retained in the part from molding. Also, if the article has a metal reinforcement, one might be able to use induction heating of the metal reinforcement to supplement other heating, or be a substitute for it. Such techniques could reduce the time needed to raise the interior of the composite material article to a temperature that suppresses the blistering and cratering defects. It is believed that this is a temperature that suppresses absorption of the solvents in the clear finish coat.

The time required to preheat the part throughout its thickness will also depend on the thickness of the part, and whether it has any exposed metal portions that extend into the interior of the part. For most SMC and RTM large automotive-type composite panels, such as rear deck lids, hoods, doors, etc., heating times of at least about 15 or 20 minutes will be needed, probably at least about 30 minutes. Composite material parts that have excessive thickness, in excess of 0.5–1 inch, may require heating of about 30–45 minutes, in order to raise interior portions to a temperature that suppresses absorption of the "paint" solvents. It is to be noted that the particular part described herein has an extremely thick section, and is heated for one hour at 155° F. Longer heating times can clearly be used but are not necessary. They may even be objectionable for some ancillary reason. This is heating time is significantly distinguished from the type of heating given to metal parts, especially stamped automotive metal parts such as rear deck lids, hoods, doors, etc., Such metal parts are substantially non-porous and are heated so quickly through their thickness in the curing process that the defects such as described herein for composite parts do not occur.

All of the foregoing discussion focussed on the clear finish coat, not the primer or color coats. However, it is to be understood that this invention can also be used when applying the primer and/or the color coats. The previous description indicates that the primer and color coatings of paint are porous. Hence, one might not expect them to exhibit the significant pitting and blistering problems of the clear finish coating. On the other hand, this should not be understood as meaning that the primer and color coatings cannot benefit at all from the principles of this invention. In point of fact, defects can also form in the primer and color coatings on composite substrate, due to absorption of paint solvent and then evaporation of it after the primer or color coat is partially or fully dry.

On the other hand, the pits, craters, or blisters that so form ill a primer or color coat on a composite part are usually small and sparsely distributed. This is perhaps due in part to the low viscosity of these paints and the absence of a long heating immediately after their application. In any event, such small pits are usually obscured by the leveling effect of the next following coat or coats. If a few pits are occasionally somewhat larger, they may be large enough that the next coat or coats will not obscure them. If so, it is not unusual to obscure them by simply filling them with some type of filler material, and then apply the next coat. Of course, if the pits in a primer or color coating are unusually large, that coating may have to be re-applied after filling the pit. On the other hand, if larger pitting and/or blistering in the primer anchor color coat becomes a more than an occasional problem, the preheating solution presented by this invention could be used to apply these coatings as well. In such instance, the added process time and expense involved in such added preheatings may become financially justified. It should be mentioned that the preheating prior to application of the primer and/or color coatings would probably not be for the same time and temperatures as used for the application of the clear finish coat. Preheating for a lesser time and/or at a lesser temperature, than before application of the clear coat, may prove to be satisfactory because of differences in chemistry and physical properties of the primer and color coatings. However, extended preheating just below the drying temperatures of these other coatings would probably provide satisfactory results. The time of heating needed to suppress absorption of a primer or color coat solvent would have to be lengthy. However, it perhaps may not have to be not quite as lengthy as for the clear finish coat, especially if higher volatility solvents are used in the primer coat and/or the color coat than in the clear finish coat.

While the above description constitutes the preferred embodiment of the invention, it will be appreciated that the invention is susceptible to modifications, variations, and changes without departing from the proper scope or fair meaning of the accompanying claims. For example, entrapment of solvents in or under the clear finish coating might also be prevented by a combination of heating the paint as well as pre-heating the composite article. Still further, use of a predominant paint solvent having a higher volatility than currently used might help reduce the preheating time and or temperature needed for the SMC or RTM composite material article.

We claim:

1. In a process for coating a fiber-reinforced plastic member selected from the group consisting of sheet molded and resin transfer molded composite material members, the improvement comprising:

heating a fiber-reinforced member having pores on a surface to be coated, said member being heated substantially throughout its thickness to a first temperature before applying to said surface a coating that has a volatile solvent that would migrate into said pores, said first temperature not differing by more than about 25° F. from a second temperature to which said member is heated after said coating is applied to said surface;

applying said coating as a liquid to said surface utilizing said volatile solvent, before said member cools to a temperature about 25° F. less than said second temperature; and heating said member to said second temperature to vaporize said volatile solvent from said coating before said member has cooled to a temperature about 25° F. less than said second temperature, whereby migration of said volatile solvent into said pores of said member is inhibited before substantial vaporization of said volatile solvent from said coating occurs.

2. The process as defined in claim 1 wherein;

the temperature of the member at the time the coating is applied and said heating to said second temperature commences, is not less than a temperature about 15° F. below said second temperature.

3. In a method of providing a gloss painted surface on a glass fiber-reinforced composite material member selected from the group consisting of sheet molded and resin transfer molded composite material members, the improvement which comprises:

providing a glass fiber-reinforced composite material member having a surface to be painted, said surface having pores communicating with capillary passages alongside glass fibers;

heating, said member for a prolonged period at least about 15 minutes at a first temperature prior to applying a paint coating onto said surface, said paint coating being subsequently applied utilizing a volatile vehicle that would migrate into said pores and be subsequently entrapped therein if left in said coating on said surface at room temperature, said first temperature not differing by more than about 25° F. from a second temperature to which said member is subsequently heated to harden said paint coating after it is applied;

applying said paint coating to said surface utilizing said volatile vehicle while internal portions of said member remain at a third temperature that inhibits migration of said volatile vehicle into said pores, said third temperature being not less than a temperature about 25° F. below said second temperature; and heating said member to said second temperature to harden said coating, while said interior portions of said member are still substantially at said third temperature to concurrently harden said coating and evaporate said volatile vehicle from said coating before detrimental migration of said volatile vehicle into said pores occurs and also before said coating hardens.

4. The process as defined in claim 3 wherein:

the temperature of said member at the time the coating is being applied and said heating to said second temperature commences is not less than temperature about 15° F. below said second temperature.

5. In a process for applying a paint coating to a fiber-reinforced thermosetting resin member selected from the group consisting of sheet molded and resin transfer molded composite material members, said process including the steps of drying the coating at an elevated temperature, the improvement which comprises:

providing a thermosetting resin member having reinforcing fibers and a surface with pores, at least some of which pores communicate with capillary passages adjacent said reinforcing fibers;

preparing said surface to receive a decorative paint coating without sealing said pores;

after preparing said surface, heating the member for at least about twenty minutes at a first temperature, said first temperature not differing by more than about 25° F. from a second temperature to which said member is subsequently heated to harden said paint coating after it is applied;

spraying a decorative paint coating onto said surface before said member has cooled from said first temperature to a third temperature that is not less than a temperature about 25° F. below said second temperature, said decorative paint coating having a volatile vehicle;

drying said decorative paint coating by heating said member to said second temperature before said member has cooled to a third temperature that is not less than a temperature about 25° F. below said second temperature to evaporate substantially all of said volatile vehicle in said decorative paint coating before an outer skin hardens on said decorative paint coating.

6. The process as defined in claim 5 wherein:

said third temperature, at the time the decorative coating is applied, is not more than about 15° below said second temperature.

7. The process of claim 5 in which: the member has a thickness of at least about one inch; the reinforcing fibers are glass fibers; and the decorative paint coating sprayed onto said surface is a clear finish coat that overlies a color coat of paint.

8. A process for minimizing defects in a multilayered paint coating on a fiber-reinforced thermosetting resin layer having a thermosetting resin foam backing and a metal reinforcement, said process including the steps of:

providing a member formed of a fiber-reinforced thermosetting resin layer having a plastic foam backing and a metal reinforcement, said layer having a surface to be painted;

preparing the surface to be painted by a process that leaves open pores in said surface to be painted, which pores can communicate said surface with an interface of said layer with said plastic foam backing;

applying at least one primer coating of paint to said surface of said layer, said at least one primer coating of paint having pores;

applying at least one color coating of paint to said surface, said at least one color coating of paint having pores;

at least some of said pores in said color coating communicating with pores on said surface of said member to be painted;

heating the member, including its foam backing and metal reinforcement, to a first temperature, said first temperature not differing by more than 25° F. from a drying temperature for a next applied clear finish coating;

while said member is at said first temperature, applying said clear finish coating to said at least one color coating, said clear finish coating having a volatile component; and while said member is still at said first temperature, externally applying sufficient additional heat to dry said clear finish coating.

9. In a process for applying a paint coating to a fiber-reinforced thermosetting resin member, said process including the steps of drying the coating at an elevated temperature, the improvement which comprises:

providing a thermosetting resin member having reinforcing fibers in an exterior layer that includes an outer surface with pores, at least some of which pores communicate with capillary passages adjacent said reinforcing fibers, said member including a subsurface thermoset resin foam interior layer;

preparing said surface to receive a clear finish coating without sealing said pores;

after preparing said surface, heating said member for at least about 30 minutes to provide a first temperature of about 150°–160° F., substantially throughout its interior;

spraying a clear finish coating onto said surface before said member has substantially cooled from said first temperature, said clear finish coating having a volatile vehicle;

drying said clear finish coating by heating said member again for at least about 30 minutes at a second temperature of about 160°–180° F. before the interior of said member has cooled from said first temperature, to evaporate substantially all of said volatile vehicle in said clear finish coating before an outer skin hardens on said clever finish coating.

10. The process as defined in claim 9 wherein: the member is selected from the class consisting of sheet molded and resin transfer molded composite material members.

* * * * *